United States Patent [19]

DiDomenico et al.

[11] 4,367,714

[45] Jan. 11, 1983

[54] FUEL INJECTION PUMP

[75] Inventors: Robert A. DiDomenico, Ludlow; John B. Cavanaugh, West Springfield, both of Mass.; John A. Kimberley, East Granby, Conn.

[73] Assignee: Ambac Industries Incorporated, Springfield, Mass.

[21] Appl. No.: 226,441

[22] Filed: Jan. 19, 1981

[51] Int. Cl.[3] ..... F02D 1/02; F02M 45/00

[52] U.S. Cl. ..... 123/449; 123/500; 417/462

[58] Field of Search ..... 123/447, 449, 450, 500, 123/501, 502, 503; 417/462

[56] References Cited

U.S. PATENT DOCUMENTS

| | | | |
|---|---|---|---|
| 2,765,741 | 10/1956 | Hogeman | 123/450 X |
| 2,935,062 | 5/1960 | Aldinger et al. | 123/450 |
| 2,947,299 | 8/1960 | Shallenberg et al. | 123/501 X |
| 3,381,615 | 5/1968 | Bailey | 123/449 X |
| 3,485,225 | 12/1969 | Bailey | 123/449 X |

*Primary Examiner*—Tony M. Argenbright

*Attorney, Agent, or Firm*—Richard D. Weber

[57] ABSTRACT

A fuel injection pump of the rotary distributor type having opposed fuel pumping pistons housed within a rotor and actuated by an internal ring cam. Fuel distribution, metering and timing control are effected through ports and slots associated with the rotor, the pump housing and a spill sleeve. The angular position of the cam is varied automatically in accordance with changes in engine speed as are the relative positions of certain ones of said ports and slots to provide an automatic advance of the fuel injection timing. The pump is particularly suited for electronic governing, electronic timing control and electronic control of rate of injection.

15 Claims, 21 Drawing Figures

FUEL INJECTION PUMP

BACKGROUND OF THE INVENTION

The present invention relates generally to internal combustion engines and relates more particularly to a fuel injection pump for use with diesel engine fuel injection systems.

Diesel engines due to their weight, cost, sluggish acceleration and noisy operation have in the past been utilized primarily for commercial applications such as trucks, locomotives, ships and stationary engines wherein their reliability, durability and economy of operation are of paramount importance. In recent years, however, the diesel engine has become more acceptable for use in light duty vehicles such as automobiles and small trucks, small tractors and the like. This acceptance has been due largely to the scarcity and high cost of gasoline, the excellent fuel economy of the diesel engine and the development of quieter diesel engines.

A common approach in light duty diesel engine design has been to utilize some type of precombustion chamber into which the fuel is injected. Although the fuel injection in the precombustion chamber type engines is less critical due to the turbulence effects which are designed to break up and disperse the injected fuel, the engine operating economy is somewhat lower than with the open chamber type engine.

In view of the urgent need to produce diesel engines having the maximum possible fuel economy, designers are turning toward the open chamber engine design for light duty diesel engines despite the more critical fuel injection requirements of such engines. In particular, the open chamber engines require much higher fuel injection pressures to provide a sufficient fuel atomization and dispersion within the combustion chamber. With the precombustion chamber type engines, fuel injection pressures of 2,000 to 4,000 psi have been adequate whereas with the open chamber type engine design, injection pressures on the order of 10,000 to 12,000 psi are required for efficient operation.

A known form of fuel injection pump for light duty diesel service is the opposed plunger rotary distributor type pump wherein the fuel pumping is effected by two or more opposed pistons disposed within a rotating member with the piston being moved radially inwardly by the engagement of the piston tappet assemblies with the lobes of an internal ring cam. This type of pump provides a relatively simple, compact pump which has been adequate for the low pressure demands of many light-duty diesel engines. In its usual form, such a pump is not suited for high pressure injection service, in large measure due to the fuel metering arrangement which is of the so-called "inlet metering" type. In this arrngement, the pumping pistons are displaced during their fill cycle only an amount sufficient to introduce the metered fuel quantity into the pumping chamber. As a result, the pumping is effected only on the downward side of the piston velocity curve with the result that the flow rate and hence the pressure developed by the pump is of a relatively low order, generally under 4,000 psi.

SUMMARY OF THE INVENTION

In the present invention, the opposed piston rotary distributor type of pump is employed but utilizing a full filling of the pumping chamber and hence a full stroke of the pumping pistons even at idle and providing novel port closing, metering and timing advance provisions within a relatively simple and compact pump structure.

The pump includes a rotor driven at a speed proportional to engine speed, the rotor comprising a pump body carrying the opposed pistons and associated tappet assemblies, and a distributor shaft cooperating with the hydraulic head and a spill sleeve through cooperating ports and slots to effect the filling of the pumping chamber as well as the fuel metering and injection timing functions. The pump body is disposed in a housing chamber on one side of the hydraulic head and is supported by the distributor shaft extending through a bore in the hydraulic head. The distributor shaft extends beyond the hydraulic head into a fuel gallery within which fuel is maintained under pressure from a supply pump. A spill sleeve mounted on the distributor shaft in the fuel gallery is moved axially along the distributor shaft by a governor mechanism to control fuel metering. A central bore in the distributor shaft connects at one end with the pumping chamber and at the other end, through port and slot arrangements, with the fuel gallery when not closed by the spill sleeve. A distributor slot in the distributor shaft communicating with the central bore sequentially aligns with distributor ports in the hydraulic head through which fuel is directed through passages in the hydraulic head to injector outlet fittings attached to the end of the pump.

An internal ring cam concentric with and overlying the pump body includes a number of internal cam lobes equal to the number of engine cylinders. The piston target assemblies engage the cam lobes to drive the pistons inwardly, thereby pumping fuel from the pumping chamber through the distributor slot and through the injector passages to the injection nozzles when the spill sleeve is positioned to close the spill ports. The beginning of injection is controlled by the closing of port closing slots of the distributor shaft which in a first embodiment of the invention are of a helical shape and cooperate with ports in the hydraulic head communicating with the fuel gallery. In this embodiment, the timing advance of injection is effected by axial movement of the rotor with respect to the hydraulic head cam, resulting in a timing advance or retard effect due to the helical shape of the spill slots and the port closing slots in the distributor shaft. Although the axial rotor movement can be effected in a number of ways in response to engine speed or load, in a preferred embodiment, the movement is effected by the use of opposed ball plates having ball detent ramps within which a plurality of balls are arranged so that the rotation of one of the ball plates will effect an axial separation of the ball plates. In the preferred embodiment, one of the ball plates is connected for rotational movement with the cam and means are provided to rotationally position the cam in accordance with engine speed which provides a simultaneous axial movement of the rotor and a change in the timing of fuel injection.

In an alternate embodiment of the invention, the rotor does not move axially but the timing as well as the metering are controlled by the spill sleeve. The port closing slot and spill slot are both located on the spill sleeve and cooperate with a port in the distributor shaft, the axial movement of the spill sleeve controlling the fuel metering while the rotation of the spill sleeve controls injection timing. The spill sleeve rotation may be effected by means of a push rod connected to a cam surface on the internal ring cam, or by means of a shaft and crank linkage to the ring cam such that rotation of the ring cam in accordance with the change in engine speed produces a resultant change in the rotational position of the spill sleeve and hence a change in the injection timing.

It is accordingly a primary object of the present invention to provide a fuel injection pump of the rotary distributor opposed piston type capable of providing relatively high injection pressures on the order of 10,000 to 12,000 psi.

It is a further object of the invention to provide a fuel injection pump as described including an automatic injection timing advance mechanism.

Another object of the invention is to provide a fuel injection pump as described which is particularly suited for electronic governing, electronic timing control and electronic control of rate of injection.

Still another object of the invention is to provide a fuel injection pump as described of a relatively simple, compact design which can be economically manufactured.

Additional objects and advantages of the invention will be readily apparent from the following detailed description of embodiments thereof when considered together with the accompanying drawings.

BRIEF DESCRIPTION OF THE DRAWINGS

FIG. 1*a* is an exploded perspective view showing the ball plate assembly of the pump of FIG. 1;

DESCRIPTION OF THE PREFERRED EMBODIMENTS

Figures 1, 11, 12:
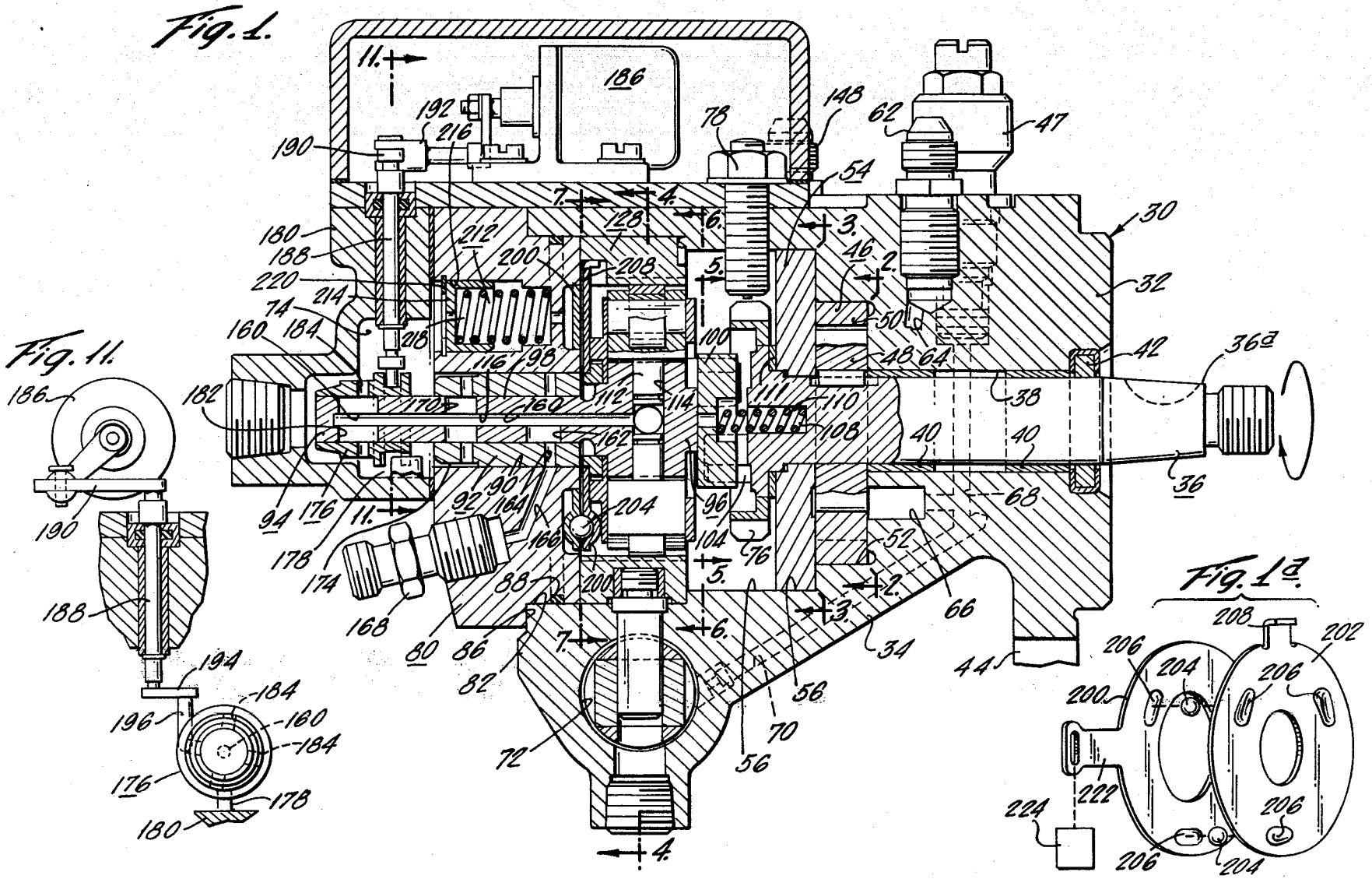
FIG. 1 is a sectional view taken longitudinally through a fuel injection pump in accordance with the present invention.
FIG. 11 is a partial sectional view taken along line 11—11 of FIG. 1 showing details of the governor control linkage.
FIG. 12 is an enlarged plan view of the rotor with the head sleeve and spill sleeve shown in broken lines.
Figure 2:
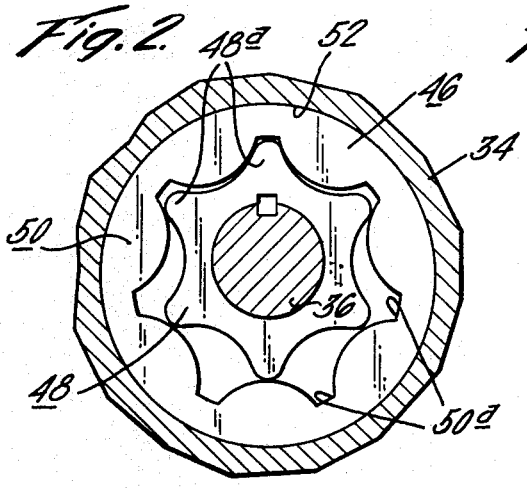
FIG. 2 is a sectional view taken along line 2—2 of FIG. 1 showing details of the supply pump.

Referring to the drawings, and particularly FIG. 1 thereof, a fuel injection pump 30 in accordance with the present invention is illustrated and includes a housing assembly 32 which includes a housing member 34 of irregular shape. A pump drive shaft 36 is rotatably disposed within a bore 38 of the housing member 34, the bore including sleeve bearings 40 and a seal ring 42. One end 36*a* of the shaft extends beyond the housing member 34 and is adapted for direct connection such as by gearing to an engine for rotation at a speed proportional to engine speed, normally one-half engine speed. The housing assembly includes a mounting flange 44 to facilitate mounting the pump directly on an engine.

Figure 3:
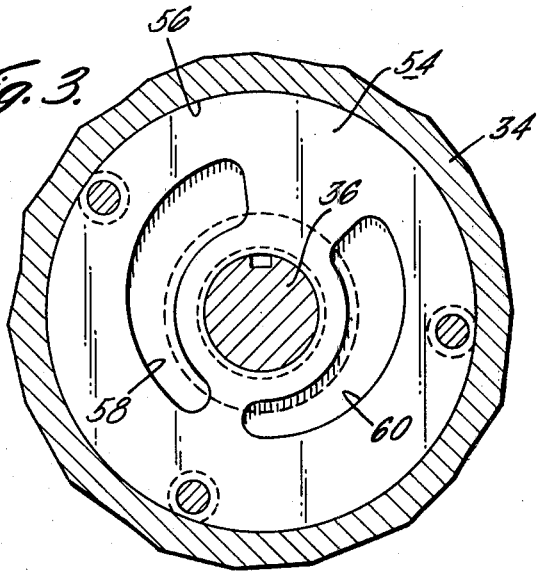
FIG. 3 is a sectional view taken along line 3—3 of FIG. 1 showing additional supply pump details.

A supply pump assembly 46 of a conventional type known as a gerotor pump includes an inner pump element 48 driven in rotation by the shaft 36 and an external pump element 50 driven in rotation by the lobes 48*a* of the inner element 48. The cylindrical outer wall of the outer element 50 is disposed for rotation in an eccentrically disposed bore 52 of the housing member 34. The pump elements 48 and 50 cooperate in a well known manner, the lobes 48*a* of the inner element 48 cooperating with the contoured recesses 50*a* of the outer element 50 to provide a compression of fuel introduced therebetween as the elements rotate. A clamping plate 54 disposed within a larger bore 56 of the housing member 34 secures the pump elements 48 and 50 in position and serves to enclose the pumping chamber formed by the bore 52. Inlet and outlet fuel channels 58 and 60 in the face of the clamping plate 54 as shown in FIG. 3 cooperate with the supply pump elements 48 and 50 and balance similar shaped channels in the housing member on the opposite side of the pump elements.

Fuel from a tank after passing through several filtration stages enters the pump through the fuel inlet fitting 62 and passes into the supply pump assembly through the passage 64 (only partially shown). The pressurized fuel from the supply pump passes from an outlet channel 66 in the housing member 34 through a passage 68 to a pressure regulating valve assembly 47, one side of which is also connected with the inlet fuel entering through fitting 62 (passage not shown). The pressure regulating valve assembly 46 maintains the pressure of the fuel from the supply pump outlet 66 at a pressure commensurate with engine speed. Pressurized fuel from the oulet 66 also passes through the passage 70 into the cylinder 72 of a piston cylinder assembly in the lower part of the housing 34, the purpose of which will be set forth in detail below. An additional passage (not shown) connects the supply pump outlet 66 with the fuel gallery 74 at the opposite end of the pump which is maintained at all times in a pressurized condition and from which fuel flows into a pumping chamber for pumping to the engine injection nozzles.

The inner end of the drive shaft 36 extends into a chamber formed by the bore 56 and includes thereon a pickup gear 76, the speed of rotation of which is sensed by a magnetic sensor 78 extending through the housing. The sensor 78 transmits electrical signals to the electric governor (not shown) to monitor speed changes of the engine and pump.

Figure 15:
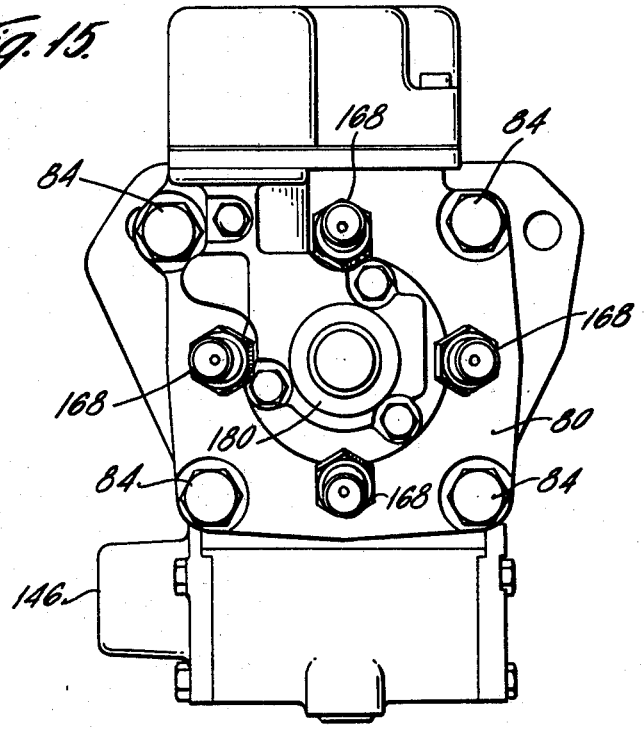
FIG. 15 is a left end elevational view of the pump of FIG. 1.

A hydraulic head 80 is disposed within a bore 82 of the housing member 34 and is secured thereto by bolts 84 (FIG. 15). The hydraulic head seats on a shoulder 86 of the housing member and is sealed in fluid tight relation with respect thereto by means of seal ring 88. The hydraulic head includes a bore 90 passing concentrically therethrough and aligned with the pump axis and the axis of the drive shaft 36. A head sleeve 92 disposed within bore 90 provides internally a bearing surface for a pump rotor 94 which includes as an integral unit a pump body 96 and a relatively small diameter distributor shaft 98. The rotor 94, which is driven in rotation by the shaft 36, also moves axially to vary injection timing as described in detail below.

Figure 5:
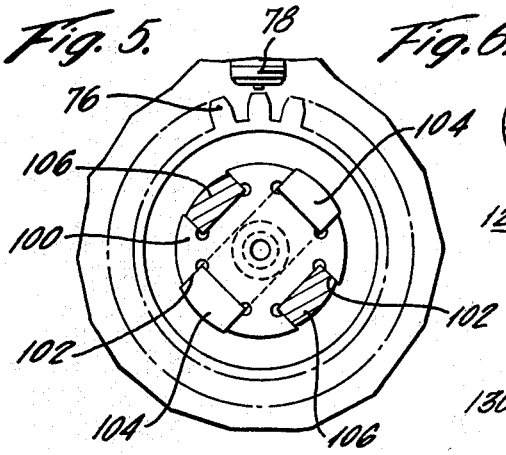
FIG. 5 is a view partly in section taken along line 5—5 of FIG. 1.
Figure 6:
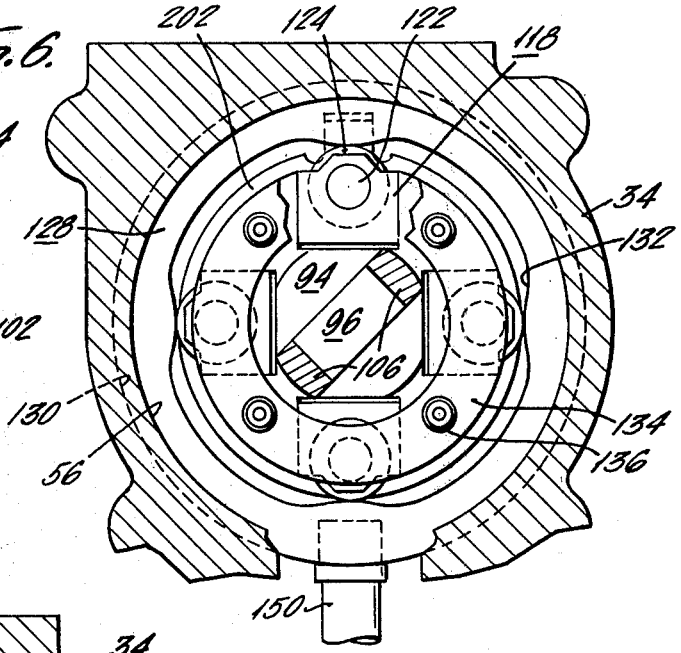
FIG. 6 is a sectional view taken along line 6—6 of FIG. 1.
Figure 7:
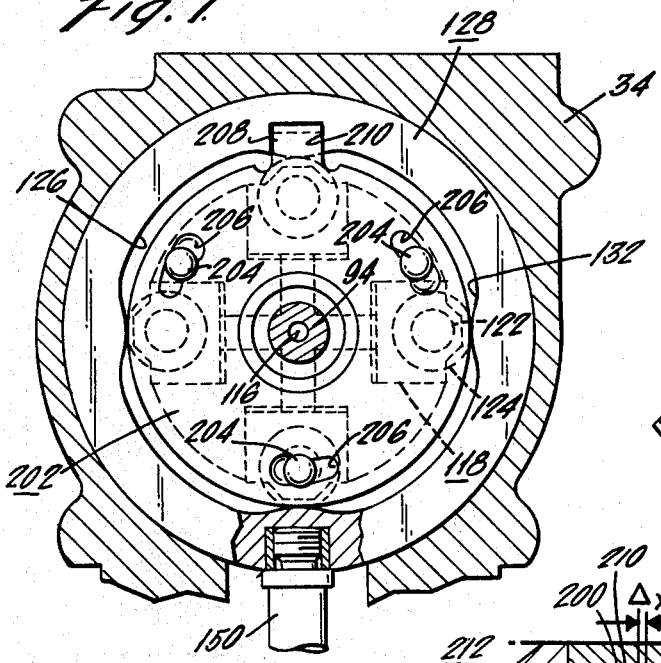
FIG. 7 is a sectional view taken along line 7—7 of FIG. 1 showing details of one of the ball plates.
Figure 8:
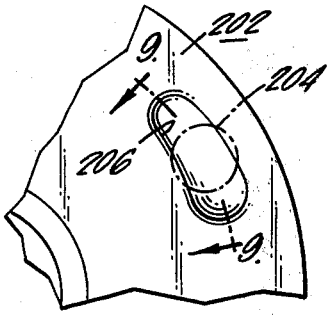
FIG. 8 is an enlarged partial view of a portion of the ball plate shown in FIG. 7.
Figure 9:
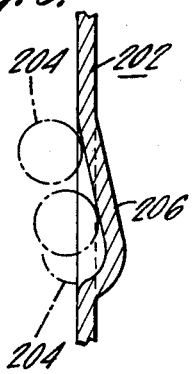
FIG. 9 is a sectional view taken along line 9—9 of FIG. 8.

The drive connection between the shaft 36 and the rotor 94 as shown in FIGS. 1, 5 and 6 includes a coupling member 100 having slots 102 therein at 90° intervals. Lugs 104 of the drive shaft 36 opposed at 180° slidably extend into diametrically opposed ones of the slots 102 while similar lugs 106 extending from the rotor extend into the remaining slots 102 of the coupling member 100. A compression spring 108 seated within an axial bore 110 of the shaft 36 bears against the coupling member 100 and holds the coupling member against the rotor. The spring also serves to urge the drive shaft 36 away from the rotor with a flange thereof bearing against a thrust washer 112 engaging the clamping plate 54. Axial movement of the rotor toward and away from the shaft 36 may accordingly take place with the lugs 104 of the drive shaft sliding within the slots 102 of the coupling member 100. The coupling member accordingly serves not only as a form of universal joint to correct any slight misalignment of the drive shaft with the rotor, but also permits an axial movement of the rotor toward and away from the shaft.

The pump body 96 comprises a cantilevered portion of the rotor within which are disposed a plurality of opposed fuel pumping pistons 112 disposed in radial bores 114 of the head. The bores 114 intersect at their inner ends, which intersection along with the adjacent portions of the bores comprises the fuel pumping chamber 116. In the pump illustrated, there are four pistons shown, but the number of pistons could vary depending upon the number of cylinders of the engine and the output requirements of the pump. The number of pistons would normally be two or four for an engine having an even number of cylinders, or three for an engine with an odd number of cylinders, for example five cylinders.

Figure 4:
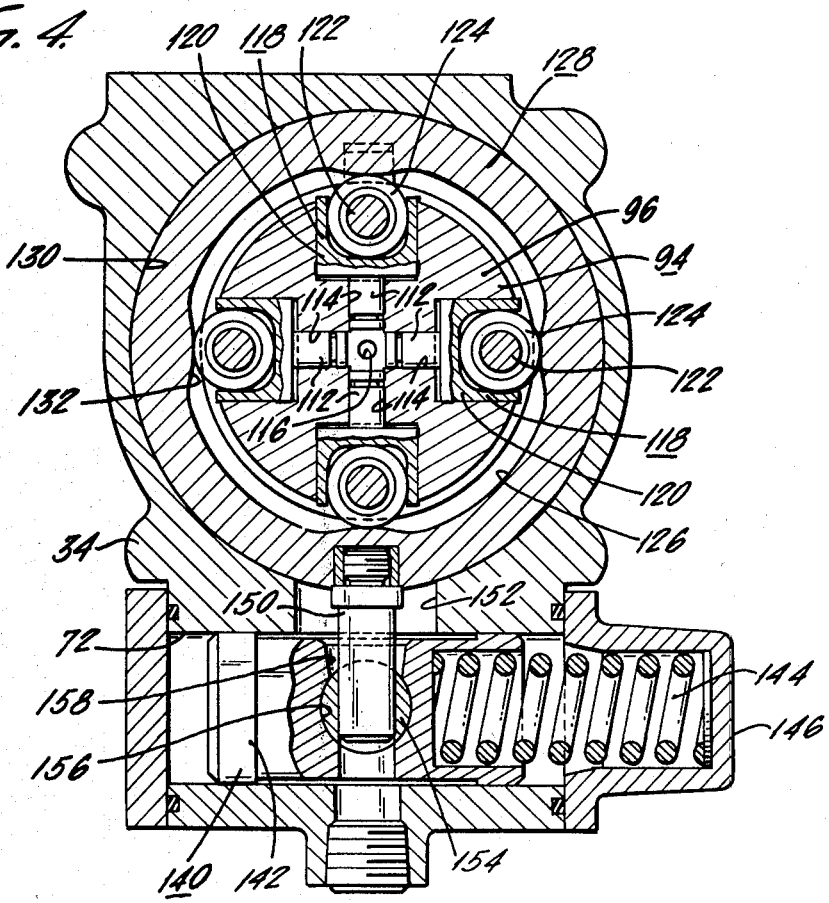
FIG. 4 is a sectional view taken along line 4—4 of FIG. 1 showing the pump body, ring cam and the means for rotating the cam in accordance with engine speed.

A tappet assembly 118 is provided for each piston 112 and includes a tappet shell 120, a pivot pin 122 and a roller 124 as shown most clearly in FIG. 4. The tappet assembly rollers continuously engage the internal cam surface 126 of an internal ring ring 128 which is rotatably disposed within a bore 130 of the housing member 34. As shown in FIG. 4, the engagement of the tappet rollers with the cam lobes 132 produces in inward movement of the pistons and effects a pumping of fuel in the pumping chamber 116.

The tappet assemblies are held in position by means of a retaining ring 134 secured to the pump head by screws 136 as shown in FIG. 6. A washer 138 serves a similar function on the opposite side of the pump head.

As shown most clearly in FIGS. 1 and 4, means are provided for rotating the cam 128 to vary the timing of the piston pumping movement with respect to the engine timing. In the illustrated embodiment, this function is effected by means of a piston-cylinder assembly 140 which comprises the cylindrical bore 72 in the housing member 34 within which a piston 142 is slidably disposed. A compression spring 144 bears against the piston 142 and against a spring housing member 146 to urge the piston to the left as viewed in FIG. 4. The pressurized fuel from the passage 70 enters the bore 72 and provides a force against the piston in opposition to the spring force. The piston is accordingly positioned as a function of engine speed in view of the variation of the fuel pressure with engine speed. A bleed passage (not shown) connects the pressurized portion of the bore 72 with the housing bore 56 which in turn is vented to drain by means of drain conduit fitting 148 at the top of the housing member 34.

The piston 142 is connected to the cam 128 by a pivot pin 150 which extends through an opening 152 in the housing member 34 and is threadedly connected to the cam ring. The pivot pin 150 extends into a bore within a roller 154 which rotates in a transverse bore 156 of the piston upon piston movement. The pin 150 passes through a tapered slot 158 in the piston which permits a sufficient piston travel to advance the cam as required by engine operating conditions.

A central bore 160 in the distributor shaft communicates with the pumping chamber and serves to supply fuel from the fuel gallery 74 to the pumping chamber. The bore 160 also serves as a conduit for the pumped fuel which is distributed by means of a distributor slot 162 sequentially to distributor ports 164 in the head sleeve 92 which connect with passages 166 in the head and the injector outlet fittings 168. As may be gained from the number of outlet fittings in FIG. 15 as well as in the number of lobes on the ring cam 128, the pump illustrated is adapted for a four cylinder engine.

In addition to the described rotary distributor function, the distributor shaft bore 160 also communicates with port closing ports which determine the start of injection as well as with spill ports which control the duration of injection and hence the metering of the fuel. Port closing slots 170 in the distributor shaft cooperate with port closing ports 172 in the head sleeve 92, the latter ports communicating with the fuel gallery 74 by means of an annulus 174 in the end of the sleeve 92. During the period of communication of the slots 170 with the ports 172, the distributor bore 60 is in communication with the fuel gallery 74 and the pumping chamber is open to the gallery to either receive fuel therefrom during the filling of the pumping chamber or to pump thereinto prior to the beginning of injection. The primary purpose of the slots 170 and ports 172 is to determine the start of injection but also serve as filling ports to resupply the pumping chamber with fuel between pumping intervals.

Slidably disposed over the extending end of the distributor shaft 98 in the fuel gallery 74 is the spill sleeve or metering sleeve 176 which is arranged to slide axially on the distributor shaft but is restrained from rotary movement by the guide 178 extending upwardly from the gallery casing 180 and cooperating with a slot in the bottom of the spill sleeve. Spill slots 182 in the distributor shaft cooperate with spill ports 184 of the spill sleeve to provide communication between the bore 160 and the fuel gallery 74, thus terminating injection.

The spill sleeve 176 is positioned axially on the distributor shaft to effect fuel metering by an axial stepping motor 186 mounted on top of the housing assembly. A mechanical linkage shown in FIG. 11 connects the motor with the spill sleeve. This linkage includes a vertical shaft 188 rotatably mounted in the casing 180 and having a crank arm 190 connected to the upper end thereof which in turn is connected to the forked arm 192 connected to the stepping motor 186. A second crank 194 is connected to the lower end of the shaft 188 which carries a downwardly extending actuating finger 196 which engages a circumferential slot in the spill sleeve 176. As viewed in FIG. 1, a leftward movement of the arm 192 of the stepping motor 186 would accordingly produce a rightward movement of the spill sleeve 176. The stepping motor 186 is connected with the electronic governor circuit and accordingly permits electronic control of the fuel metering.

Figure 13:
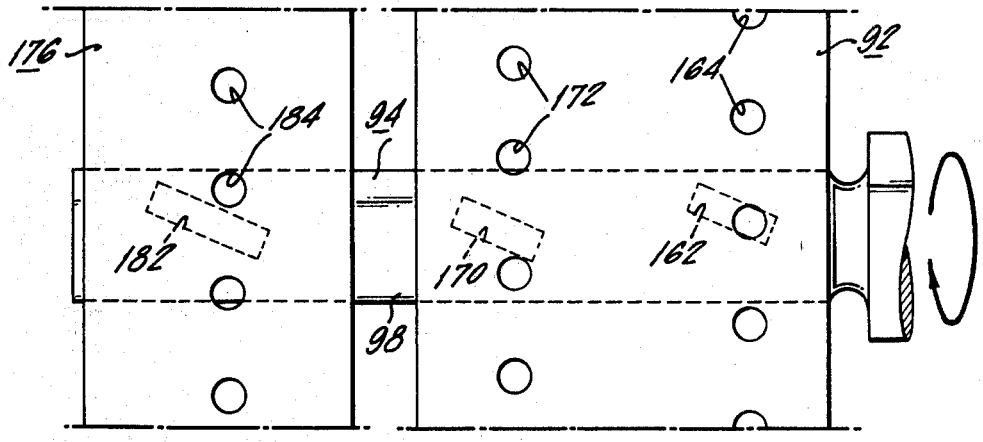
FIG. 13 is a development view showing the relationship of the distributor, port closing and spill slots with respect to the distributor, port closing and spill ports.
Figure 14:
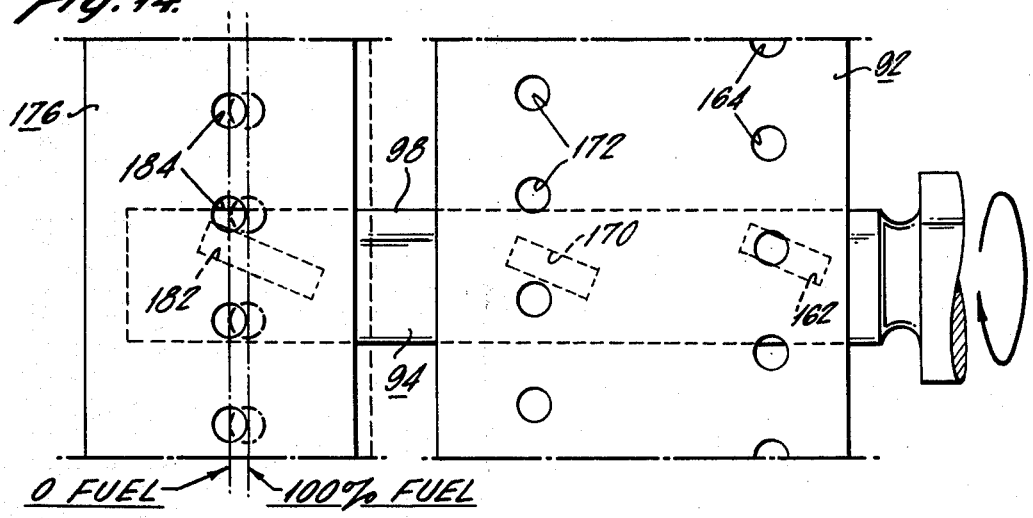
FIG. 14 is a view similar to FIG. 13 showing the distributor shaft moved axially to the right in response to speed advance of the engine.

With reference to FIGS. 12–14, it can be seen that the spill slots 182, port closing slots 170, and the distributor slot 162 are helically inclined with respect to the axis of the distributor shaft. The manner in which the spill sleeve functions to meter fuel will accordingly be apparent, particularly with reference to FIG. 14 wherein the permissable range of movement of the spill sleeve is illustrated from zero fuel in solid lines to the 100% fuel position in broken lines.

The views of FIGS. 13 and 14 are development views and show the manner of cooperation of the distributor shaft slots with the ports of the spill sleeve 176 and the head sleeve 92. In view of FIG. 13, the port closing slot 170 has just cleared the port closing port 172, signalling the beginning of injection. The distributor port 162 is aligned with one of the distributor ports 164 permitting fuel to be pumped into the injection nozzle connected with that particular distributor port until the spill slot communicates with one of the spill ports 184. At that time, the distributor shaft bore 160 will communicate with the fuel gallery 174 and the pumping chamber will be dropped to gallery pressure, allowing the injection nozzle to close.

Timing advance of the fuel injection is effected by means which moves the rotor 94 axially as a function of increasing engine speed. In FIG. 14 the rotor is illustrated as moved to the right in response to increased engine speed, and accordingly due to the helical angle of the distributor slot 162, port closing slot 170 and spill slot 182, will result in an earlier engagement of those slots with their associated ports. Since the helix angle of the slots is the same, the metering of the fuel is not effected by such an axial shift of the rotor since the earlier termination of injection is offset by an equally earlier commencement of injection.

Although various arrangements could be employed to shift the rotor axially in accordance with engine speed, in the illustrated embodiment a pair of ball plates 200 and 202 are disposed in juxtaposed relation with a plurality of balls 204 being disposed in ball ramps 206 on the plates. A relative rotation of the plates will accordingly serve to change the axial spacing of the plates as the balls assume different positions on the ball ramps.

Figure 10:
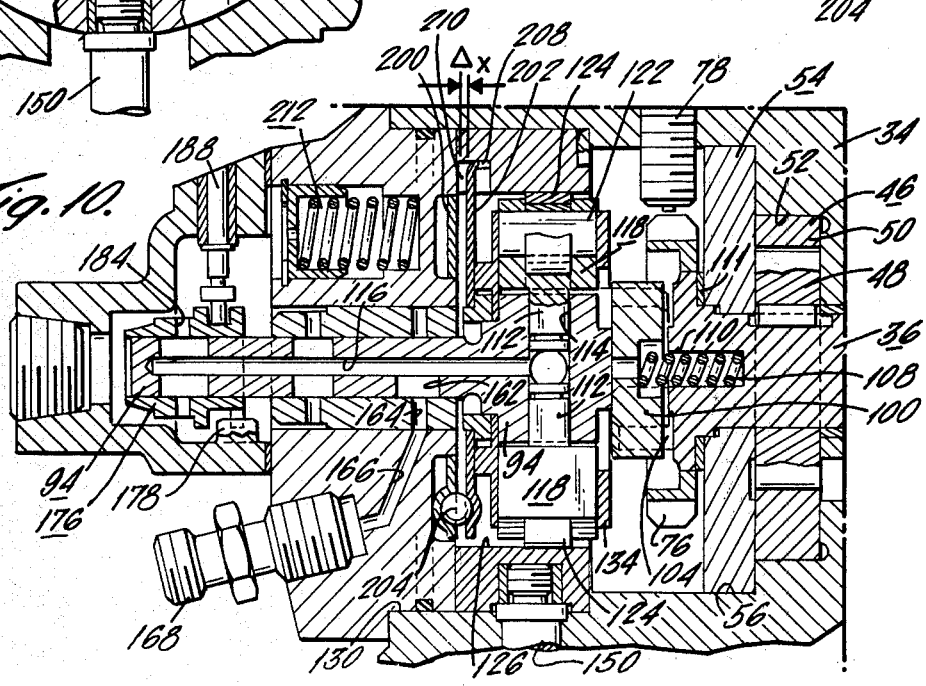
FIG. 10 is a partial view of the pump as shown in FIG. 1 but with the pump rotor shifted to an advance timing position.
Figure 12:
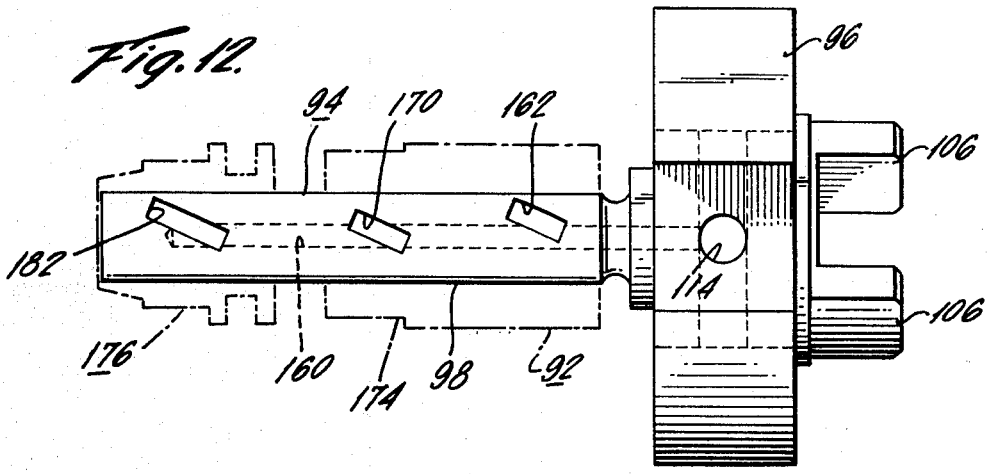

The ball plate 202 includes a tang 208 extending at the upper end thereof which engages a slot 210 in the cam 128. The ball plate 202 will accordingly rotate with the cam 128 as a function of engine speed. As the engine speed increases, and the cam 128 is rotated counterclockwise as viewed in FIG. 4, the rotor will by operation of the ball plates and balls move toward the right as viewed in FIG. 1 and accordingly advance the timing of the fuel injection. In FIG. 10, the pump as shown in FIG. 1 is illustrated with the rotor moved to an advanced timing position. Such rotor movement is permissible in view of the allowable compression of spring 108 and the sliding coupling 100 connecting the rotor to the drive shaft 36. In addition, the tappet rollers 124 can slide axially within the cam 128 which, as shown in FIG. 1, is of a sufficient width to accommodate such movement. Likewise, the tang 208 of the ball plate 202 has ample room to slide axially within the slot 210 of the cam 128 as shown in FIG. 1. The spring 108 serves to return the rotor toward a retarded timing position and maintains the ball plates in continuous engagement with the balls.

An accumulator assembly 212 includes a piston 214 slidably disposed within a bore 216 of the hydraulic head 80. A compression spring 218 is provided to urge the piston 214 toward a stop ring 220. The bore 216 opens into the fuel gallery 74 and surges in pressure within the gallery 74 occurring upon fuel spill at the end of injection are absorbed by resilient movement of the accumulator piston against the spring 218, effectively expanding the volume of the fuel gallery momentarily to absorb the fuel surges. The portion of the bore 216 occupied by the spring 218 is vented into the chamber within the housing bore 56 so that the right hand side of the accumulator piston is at a low substantially ambient pressure.

Figure 16:
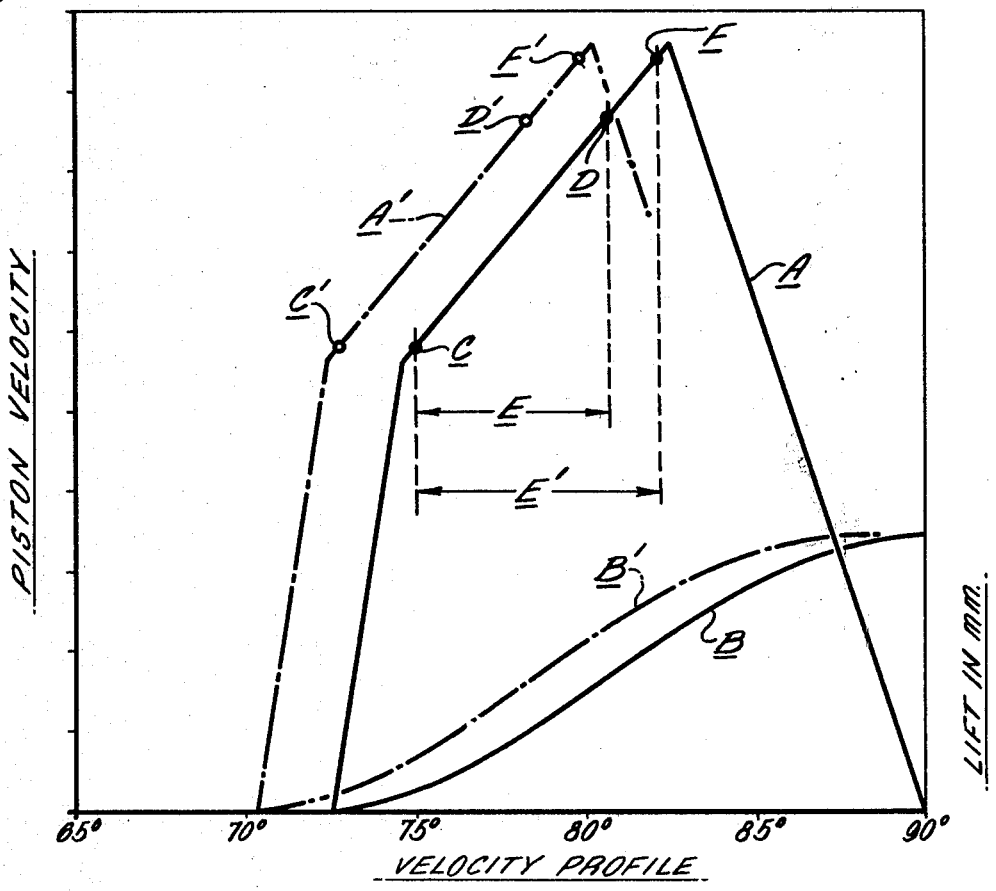
FIG. 16 is a graph showing the piston velocity curve along with the cam lift curve for two different timing positions of the pump.

In FIG. 16, curve A represents the piston velocity of the pump pistons 112 plotted against angular rotation of the rotor. Curve B represents the cam lift plotted against rotor rotation. To obtain the maximum pumping pressure, the pumping interval should take place during a time period of high piston velocity and preferably of increasing piston velocity. Accordingly, a preferred time for the start of injection is indicated by the point C on the velocity curve with a typical termination being represented by point D. The angular duration of injection for this example is represented by the distance E. In an example of a larger fuel delivery, injection is not terminated until point F resulting in an injection duration of angular length E′.

For the timing advance of the pump, the cam 128 is itself rotated as described above with a resultant shifting of the cam lift curve to the line B′ shown in broken lines. This has the effect of shifting the piston velocity curve to the new position A′ also shown in dot-dash lines. Since the start and end of injection are also advanced with the advance of the cam, the injection will commence at a new point C′ and the termination of injection will similarly be shifted as shown by the points D′ and F′ on the graph.

From the foregoing description of the embodiment of the invention as well as from the discussion of the graph of FIG. 16, it can be seen that the shifting of the cam along with the shifting of the rotor as effected by the ball plate assembly maintains the injection interval on the preferred portion of the piston velocity curve. However, under some engine operating conditions it may be desirable to shift the injection intervals in one direction or the other along the velocity curve to provide a different rate of injection. This can be accomplished quite readily with the present pump simply by providing means for rotating the ball plate 200 which normally is fixed in position against the hydraulic head 80. In the exploded perspective view of FIG. 1*a*, the ball plate 200 is shown with an extending arm 222 which extends through the pump housing for connection to an actuator 224. The rotation of the ball plate 200 may thus be controlled in accordance with engine operating conditions to shift the injection interval on the piston velocity curve and thereby obtain the desired rate of injection. Although the actuator 224 may take any desired form, a preferred form would be an electrical actuator such as a stepping motor similar to the motor 186 which could be controlled from a central electrical control system such as a microprocessor monitoring the overall engine operation.

Figure 17:
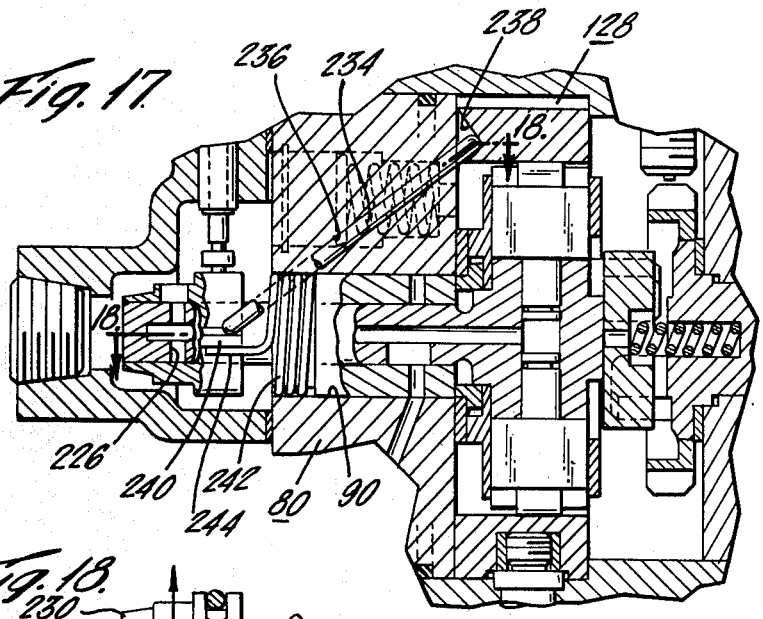
FIG. 17 is a sectional view of a portion of a pump similar to FIG. 1 showing a modified arrangement for controlling fuel metering and timing advance.
Figure 18:
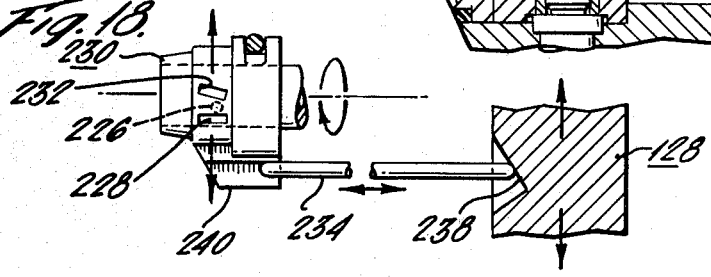
FIG. 18 is a sectional view taken along line 18—18 of FIG. 17 with the salient parts being isolated to show their interaction.

A modified form of pump is shown in FIGS. 17 and 18. In this modified embodiment, all of the pump elements and functions shown in FIG. 1 are the same except for the elements involved with fuel metering and injection timing control and accordingly bear the same reference numerals. The ball plates are eliminated in the embodiment of FIGS. 17 and 18, and the rotor does not move axially. In addition, the port closing slots and ports in the distributor shaft and head sleeve have been eliminated. Further, the spill slots have been replaced by four spill ports 226 in the distributor shaft each of which sequentially communicates with a port closing slot 228 of the spill sleeve 230 and a spill slot 232 thereof. From FIG. 18 it can be seen that the port closing slot is parallel with the axis of the distributor shaft and hence the start of injection will not be changed by an axial movement of the spill sleeve on the shaft. The spill slot 232 however is helically aligned with respect to the distributor shaft axis and hence a movement of the sleeve toward the right as viewed in FIGS. 17 and 18 will result in a longer angular duration of injection and hence a greater fuel delivery.

The timing advance of the pump embodiment of FIGS. 17 and 18 is accomplished by rotation of the sleeve 236 on the distributor shaft. This rotation is effected by a push rod 234 disposed within a bore 236 in the hydraulic head 90 and which engages a camming surface 238 in a slot of the cam 128. The other end of the push rod 234 slidably engages a flange 240 of the spill sleeve 230 and urges the spill sleeve flange downwardly to cause a rotation of the sleeve against the force of a torsion spring 242 disposed in the bore 90 of the hydraulic head 80. A free arm 244 of the spring 242 extends beneath the flange 240 and urges the flange upwardly. The spring 242 accordingly will urge the spill sleeve 230 toward a retard position while the push rod 236 will upon camming movement by the cam surface 238 move the sleeve 230 toward an advanced timing position. Since the angular spacing between the port closing slot 228 and the spill slot 232 is not changed by the rotation of the sleeve 230, the fuel metering is not effected by the rotation of the sleeve. Nor is the timing affected by changes in the fuel metering since the sleeve can move axially along the distributor shaft with the flange 240 sliding with respect to the push rod 236 and the spring arm 242.

Figure 19:
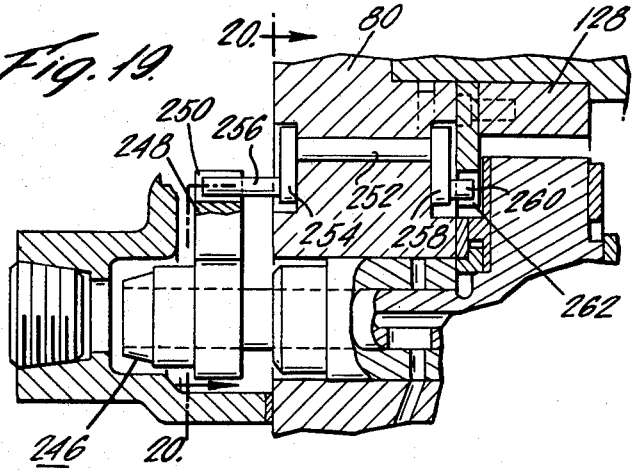
FIG. 19 is a sectional view of a pump similar to that of FIG. 17 showing a modified arrangement for controlling the timing advance.
Figure 20:
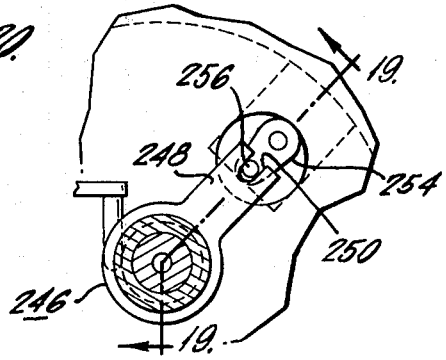
FIG. 20 is a view taken along line 20—20 of FIG. 19.

In FIGS. 19 and 20, a modified form of the embodiment of FIGS. 17 and 18 is illustrated wherein the linkage between the cam 128 and the spill sleeve is changed. In the form of FIGS. 19 and 20, the spill sleeve 246 is identical to the spill sleeve 226 of FIGS. 17 and 18 except that the flange 240 is removed and in its place an arm 248 extends upwardly and includes a slot 250 in the end thereof. A shaft 252 rotatably carried by the hydraulic head 90 includes a crank 254 at one end thereof from which a rod 256 extends into engagement with the slot 250 of the spill sleeve arm 248. Another crank 258 is disposed on the opposite end of the shaft 252 and carries an arm 260 which engages a slot 262 in the cam 128. Movement of the cam ring toward a timing advance position will accordingly rotate the shaft 252 in a counterclockwise direction as viewed in FIG. 20 and will provide a clockwise rotation of the spill sleeve 246 and a resultant advance in injection timing. The embodiment of FIGS. 19 and 20 accordingly differs from that of FIGS. 17 and 18 only in the linkage connecting the spill sleeve with the cam 128 for effecting rotation of the spill sleeve with rotation of the cam.

Although the illustrated and described embodiments have shown a timing advance arrangement serving to adjust pump timing as a function of engine speed, it will be apparent that timing may also be a function of other engine conditions such as engine load, and the invention may be readily adapted for such operation. For example, the pressure applied to the piston 142 can be modulated and fine tuned electronically in accordance with engine conditions. In another arrangement, the cam rotation can be controlled directly by means of a electrical actuator in place of the illustrated hydromechanical actuator.

Similarly, although a direct mechanical linkage has been shown for varying the injection timing in accordance with the cam rotation, independent means such as electrical or hydraulic means could be provided for varying the injection timing as a function of engine conditions.

The permissible axial shifting of the rotor independently of the cam available with the embodiment of FIG. 1 is of particular value in automotive applications since it permits a variation in the rate of injection. One possible application of this feature is the reduction of engine noise at low speed by lowering the rate of injection.

Although in the illustrated embodiment of FIG. 1, the helix angles of the spill slots and the port closing slots are the same, if desired these helix angles could be different and would then change the metered fuel quantity as a function of engine timing.

An advantageous feature of the invention is the placement of the rotor and the spill sleeve at opposite ends of the distributor shaft, allowing a reduction in the diameter of the distributor shaft to minimize shaft leakage while providing adequate strength to support the rotor.

Althrough the gerotor type supply pump has been illustrated, it will be evident that other types of positive displacement pumps may also be utilized, for example gear pumps, vane type pumps, etc.

Similarly, other types of accumulators could be substituted for the piston type accumulator illustrator, for example, a metal diaphragm type accumulator.

Manifestly, changes in details of construction can be effected by those skilled in the art without departing from the spirit and scope of the invention.

We claim:

1. A fuel injection pump for a diesel engine comprising a housing assembly, a rotor disposed within said housing assembly, means for driving said rotor in rotation at a speed corresponding to engine speed, said rotor comprising a pump body and a distributor shaft, a hydraulic head in said housing assembly, a bore in said hydraulic head for rotatably supporting said rotor distributor shaft, opposed pistons disposed within radial bores of said pump body, said pump body radial bores intersecting to form a pumping chamber, tappet assemblies associated with each said piston, an internal ring cam disposed in said housing concentrically with said rotor for cooperation with said tappet assemblies to provide a pumping movement of said pistons upon rotation of said rotor, means for varying the rotational position of said cam in response to changes in engine operating conditions, an axial bore within said distributor shaft communicating with said pumping chamber, a distributor slot in said distributor shaft, a plurality of spaced distributor ports in said hydraulic head, said distributor slot aligning sequentially with said distributor ports upon rotation of said rotor, passage means in said hydraulic head communicating with said distributor ports for connecting said ports with the engine fuel injection nozzles, a fuel gallery adjacent one end of said hydraulic head, means for supplying fuel under pressure to said fuel gallery, said pump body being disposed adjacent the other end of said hydraulic head at one end of said distributor shaft, the opposite end of said distributor shaft extending beyond said hydraulic head into said fuel gallery, a spill sleeve on said extending end of said distributor shaft, slot and port means on said distributor shaft and spill sleeve for providing a communication of said distributor shaft bore and said gallery to effect termination of injection, fuel metering control means for varying the position of said spill sleeve with respect to said distributor shaft in accordance with the operating conditions and the fuel demands of the engine, port closing means for providing fluid communication between said distributor shaft bore and said fuel gallery during an initial portion of the pumping stroke of said pistons and for cutting off said communication to initiate fuel injection, and timing control means for simultaneously changing the timing of the closing of said port closing means and the opening of said spill sleeve and distributor shaft slot and port means.

2. The invention as claimed in claim 1 wherein said port closing means comprises port closing slots in said distributor shaft and port closing ports in said hydraulic head aligned for intermittent communication with said port closing slots, said port closing ports communicating with said fuel gallery.

3. The invention as claimed in claim 2 wherein said distributor shaft includes spill slots in the extending end thereof, and a spill port in said spill sleeve disposed for intermittent communication with said spill slots to effect injection termination.

4. The invention as claimed in claim 3 wherein said spill slots are helically disposed with respect to the axis of said distributor shaft and wherein said fuel metering control means comprises means for varying the axial position of said spill sleeve on said distributor shaft.

5. The invention as claimed in claim 4 wherein said port closing slots in said distributor shaft are helically aligned with respect to the axis of said shaft and wherein said timing control means comprises means for axially moving said rotor with respect to said spill sleeve and hydraulic head.

6. The invention as claimed in claim 5 wherein said means for axially moving said rotor comprises a pair of juxtaposed ball plates, a plurality of ball ramps on each of said ball plates, a plurality of balls disposed in said ball ramps between said plates, and means for providing relative rotation of said ball plates to vary the axial spacing therebetween.

7. The invention as claimed in claim 6 wherein one of said ball plates is connected with said cam for rotation therewith.

8. The invention as claimed in claim 7 wherein the other of said ball plates is selectively rotatable, and means for selectively rotating said other ball plate in accordance with engine conditions to change the rate of injection.

9. The invention as claimed in claim 1 wherein said slot and port means comprises a plurality of spill ports in said distributor shaft communicating with said distributor shaft bore, and wherein said spill sleeve includes a spill slot therein for intermittent communication with said spill ports to effect injection termination.

10. The invention as claimed in claim 9 wherein said spill slot is helically angled with respect to the axis of said distributor shaft.

11. The invention as claimed in claim 10 wherein said port closing means comprises a port closing slot in said spill sleeve adapted for intermittent communication with said distributor shaft spill ports.

12. The invention as claimed in claim 11 wherein said port closing slot is aligned parallel with the axis of said distributer shaft.

13. The invention as claimed in claim 12 wherein said fuel metering control means comprises means for varying the axial position of said spill sleeve on said distributor shaft.

14. The invention as claimed in claim 13 wherein said timing control means comprises means for rotating said spill sleeve on said distributor shaft in accordance with changes in engine operating conditions.

15. The invention as claimed in claim 14 wherein said means for rotating said spill sleeve comprises a mechanical linkage with said cam to effect a rotation of the spill sleeve commensurate with the rotation of the cam in response to changes in engine operating conditions.

* * * * *